US006719524B2

(12) United States Patent
Nguyen et al.

(10) Patent No.: US 6,719,524 B2
(45) Date of Patent: Apr. 13, 2004

(54) METHOD OF FORMING A THERMALLY ISOLATED GAS TURBINE ENGINE HOUSING

(75) Inventors: Ly D. Nguyen, Phoenix, AZ (US); Louis Cruse, Scottsdale, AZ (US); Ivar Gene Fowkes, Tempe, AZ (US); Silvestre Salas, Chandler, AZ (US); William North, Tempe, AZ (US); Vadanth Kadambi, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 37 days.

(21) Appl. No.: 10/084,858

(22) Filed: Feb. 25, 2002

(65) Prior Publication Data

US 2003/0161716 A1 Aug. 28, 2003

(51) Int. Cl.[7] ..... F01D 25/12

(52) U.S. Cl. ..... 415/1; 415/116; 415/176; 415/178

(58) Field of Search ..... 415/1, 115, 116, 415/176, 178

(56) References Cited

U.S. PATENT DOCUMENTS 3,826,084 A 7/1974 Branstrom et al.
4,079,587 A 3/1978 Nordström et al.
4,466,239 A 8/1984 Napoli et al.
4,487,016 A 12/1984 Schwarz et al.
4,541,775 A 9/1985 Hovan
4,645,415 A 2/1987 Hovan et al.
4,920,742 A 5/1990 Nash et al.
5,142,859 A 9/1992 Glezer et al.
5,169,287 A 12/1992 Proctor et al.
5,212,940 A 5/1993 Glover
5,273,397 A 12/1993 Czachor et al.
5,291,733 A 3/1994 Halila
5,461,866 A 10/1995 Sullivan et al.
5,597,286 A 1/1997 Dawson et al.
5,634,767 A 6/1997 Dawson
6,050,079 A 4/2000 Durgin et al.
6,227,800 B1 5/2001 Spring et al.

*Primary Examiner*—Edward K. Look
*Assistant Examiner*—Kimya N McCoy
(74) *Attorney, Agent, or Firm*—Robert Desmond, Esq.

(57) ABSTRACT

A method for forming a thermally isolating gas turbine housing from the significantly high temperatures associated with the combustion gases flowing through the housing. A floating liner is positioned within the turbine housing with an outer baffle arranged about the floating liner and an inner baffle arranged within the floating liner. The inner and outer baffles are welded or brazed to the floating liner assembly to form a unitary assembly creating a single, continuous cooling passageway within the housing for collecting heat from adjacent the surfaces of the floating liner and expelling the heat into the combustion exhaust stream.

20 Claims, 9 Drawing Sheets

METHOD OF FORMING A THERMALLY ISOLATED GAS TURBINE ENGINE HOUSING

This invention was made with government support under contract no. DAAJ02-94-C-0030 with the U.S. Army. The government has certain rights in the invention.

BACKGROUND OF THE INVENTION

The present invention is directed to a gas turbine engine assembly of a type capable of operating at elevated temperatures. In particular, the present invention is directed to a method of creating a single cooling circuit for thermally isolating the turbine housing from high temperatures that would otherwise adversely impact the delivery of cooling air/oil through the high temperature gas path to cool bearings, seals, nozzles and other engine components as well as maintaining the housing structural integrity.

Recent advances in turbine engine technology utilize ceramic combustor technology which can operate at temperatures exceeding even 2500° F. It is essential that some housings must be cooled effectively and efficiently. Cooling the engine components while maintaining and even increasing engine efficiency and power are possible by operating at such higher temperatures without compromising the system.

Typically, such high temperature gas turbine engines require many complex cooling circuits to isolate the housing from high temperature gases. Separate cooling circuits are often utilized to cool the gas path liner and air/oil passages extending through the struts as required for lubrication of bearings, seals, turbine blades and associated engine components.

To insure adequate cooling, engine assemblies currently may utilize a circular inner hub and outer housing or shroud joined by a number of radially-extending support struts passing through the hot gas flow path. The struts may have hollow core areas extending lengthwise through the core for delivering air/oil to cool the bearings, nozzles and other components. The design of such inner hubs may accommodate bearings and various seal arrangements, while the outer shroud supports other ancillaries. The separate cooling circuits required for such shroud and hub assemblies are complex and expensive to fabricate and maintain.

There clearly is a need for an apparatus and method of creating a single cooling circuit which is simply supported within the engine compartment and capable of successfully isolating the engine housing from the high temperatures created by the gas combustion process, thereby enabling the housing to deliver cooling air to the bearings, seals, nozzles and other engine components. As will be explained, the present invention provides a method of fabricating an apparatus and system for achieving a thermally isolated gas turbine engine housing assembly.

SUMMARY OF THE INVENTION

In one aspect of the present invention, a method is disclosed for thermally isolating a turbine engine housing from high temperatures created by combustion gases flowing through the engine housing. The method includes the step of forming a floating liner assembly with a plurality of openings extending there through and forming an outer baffle assembly with a plurality of openings extending there through. The method further includes the step of forming an inner baffle assembly with a plurality of openings extending there through. The method includes the step of arranging the floating liner assembly, the outer baffle assembly and the inner baffle assembly in the turbine engine housing to form a single passageway for conveying a stream of compressed, cooling air against surfaces of the floating liner to collect heat from the floating liner and expel the heat into the stream of combustion gases flowing through the turbine engine housing.

In another aspect of the invention, a method is disclosed for fabricating an apparatus for thermally isolating a gas turbine engine housing having an outer ring-shaped housing member and an inner hub attached by housing struts from high temperatures created by combustion gases flowing through the turbine engine. The method comprises the step of positioning a floating liner assembly between the inner hub and the outer ring-shaped housing member and arranging a plurality of liner struts to enclose the housing struts, with a plurality of openings extending through the floating liner. The method includes the further step of positioning an outer baffle assembly about the floating liner assembly, with a plurality of openings extending through portions of the outer baffle assembly and the step of positioning an inner baffle assembly within the floating liner assembly, with a plurality of openings extending through portions the inner baffle. Finally, the method creates a single, continuous passageway for delivering pressurized air through openings in the outer ring-shaped housing member that impacts and flows through the openings in the outer baffle assembly, the floating liner assembly, the liner struts and the inner baffle assembly for collecting heat from the floating liner and expelling the heat to a stream of combustion gases flowing through the gas turbine engine.

In a yet further aspect of the present invention, a method is disclosed for thermally isolating a gas turbine outer ring-shaped housing member from high temperatures created by combustion gases flowing through the turbine engine. The method comprises the steps of positioning a floating liner assembly between an inner hub and the outer ring-shaped housing member and forming the floating liner assembly from separate, inner and outer ring-shaped liner members, having a number of openings, forming a cooling air passageway around each of the floating liner members and positioning an outer baffle assembly having two similar, generally cylindrically-shaped members to surround the floating liner outer ring-shaped member, and forming the outer baffle assembly with a plurality of through openings. The method further comprises the step of positioning an inner baffle assembly having two similar, generally cylindrically-shaped members within the floating liner inner ring-shaped member, and forming the inner baffle assembly with a plurality of openings extending through each outer baffle member. Finally, the method creates a single, continuous passageway for delivering pressurized air through openings in the outer ring-shaped housing member that impacts and flows through the openings in the outer baffle assembly, the floating liner assembly, the liner struts and the inner baffle assembly for collecting heat from the floating liner and expelling the heat to a stream of combustion gases flowing through the gas turbine engine.

These and other features, aspects and advantages of the present invention will become better understood with reference to the following drawings, description and claims.

DETAILED DESCRIPTION OF THE INVENTION

The following detailed description is of the best currently contemplated modes of carrying out the present invention. The description is not to be taken in a limiting sense, but is made merely for the purpose of illustrating the general principles of the invention, since the scope of the invention is best defined by the appended claims.

Figure 1:
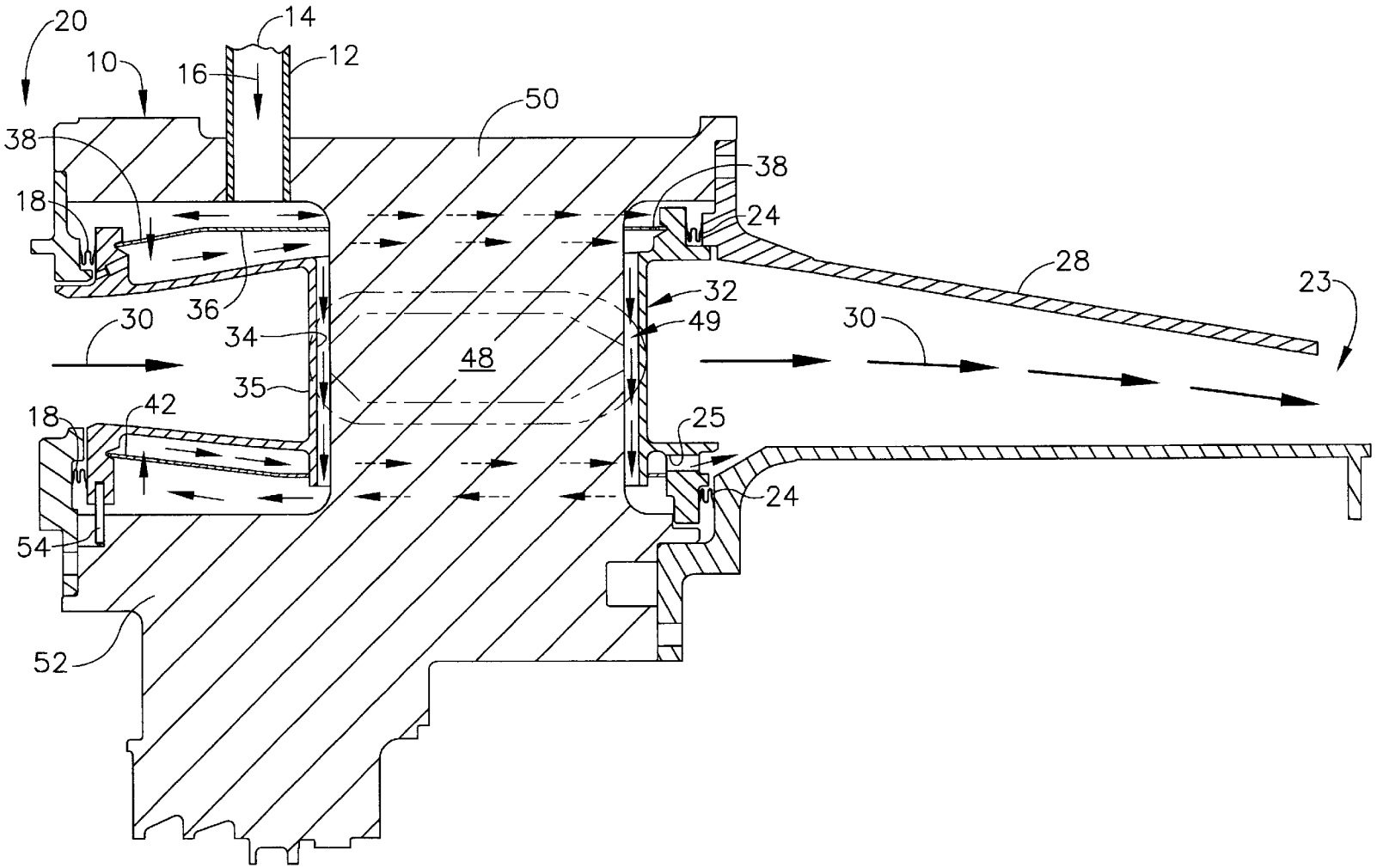
FIG. 1 is a schematic view of a gas turbine engine having a thermally cooled housing assembly formed in accordance with the present invention.

The gas turbine engine formed in accordance with the present invention includes an assembly and system for thermally isolating housing from high temperatures in the gas path that otherwise adversely affect the housing and its cooling passages. The apparatus allows the turbine engine to function without thermal interference of the type caused by transient conditions existing during system startup and shutdown. Referring now to FIG. 1, a thermally isolated housing assembly is shown at 10. An inlet pipe 12 can be attached to housing 10 and may deliver a quantity of relatively cool, compressed air through a number of inlets 14 extending through housing 10. As shown by the arrows 16, a portion of the compressed cooling air may circulate in a forward direction through the housing until reaching typical metal seals 18 located at the forward end 20 of the turbine engine. The cool air 16 may continue to flow through a cavity created between the liner 35 and strut 48 to the hub of the housing 10. A further portion of the cooling air 16 may also flow towards forward end 20 of the turbine engine to cool the hub of the housing 10 prior to flow towards the rear end of the engine housing. The cooling air 16 may pass adjacent the rear metal air seals 24 before being expelled from the air circuit through one or more outlets 25. The expelled cooling air can mix with the turbine gas 30 flowing through the exhaust nozzle 28.

Figure 2:
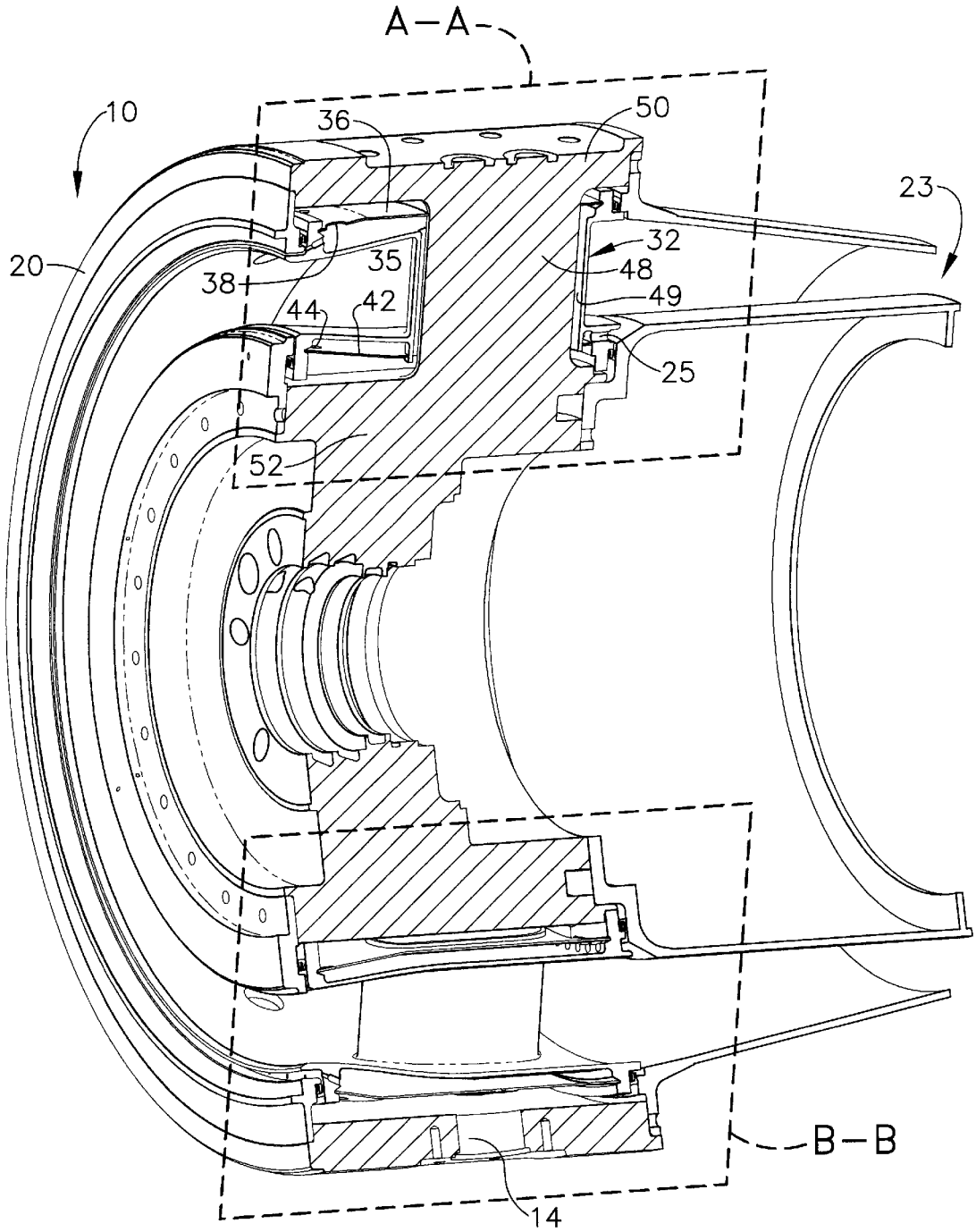
FIG. 2 is a perspective view of one-half the thermally cooled housing assembly formed in accordance with the present invention.
Figure 5:
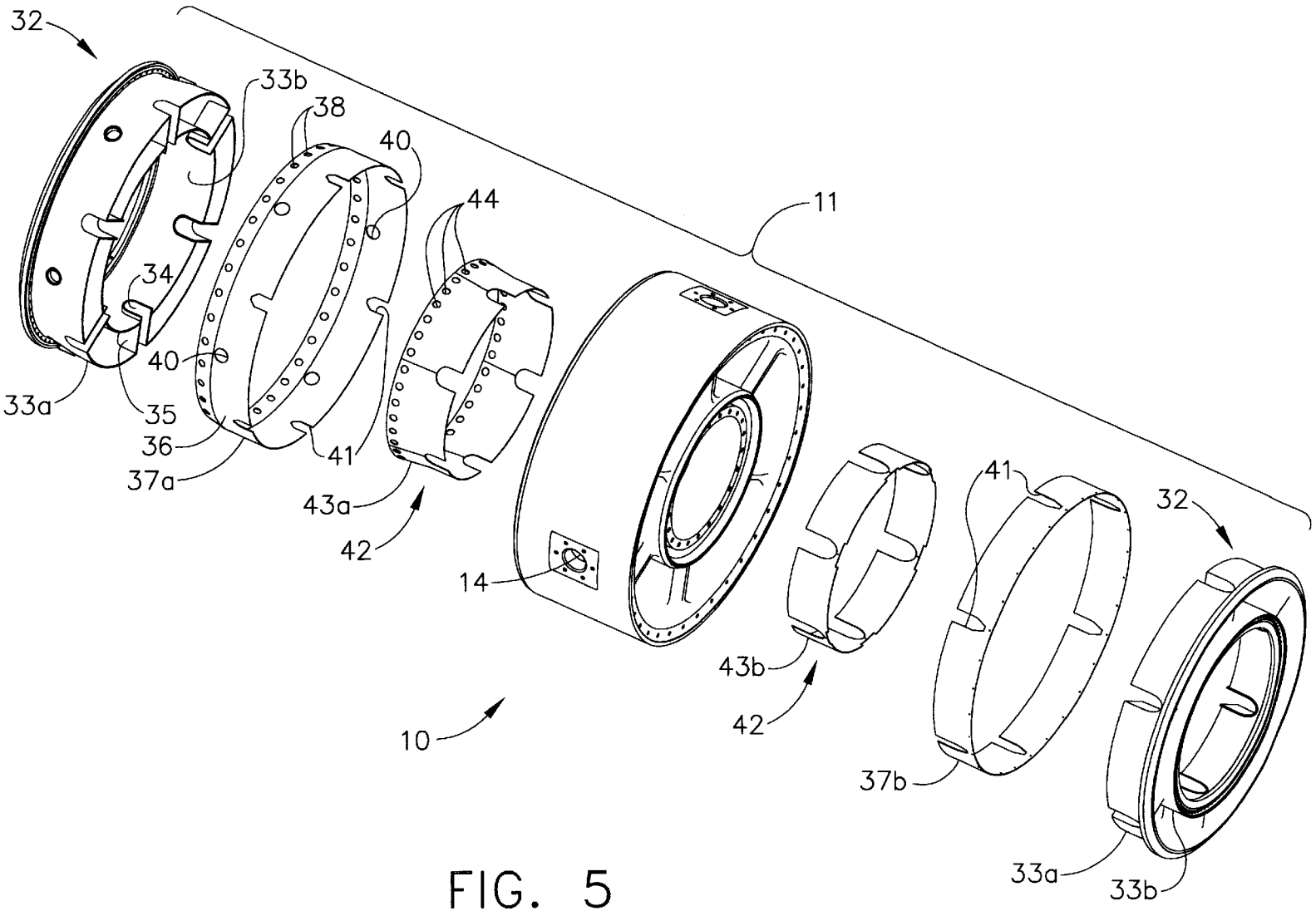
FIG. 5 is a perspective view of the thermally cooled housing assembly formed in accordance with the present invention.
Figure 6:
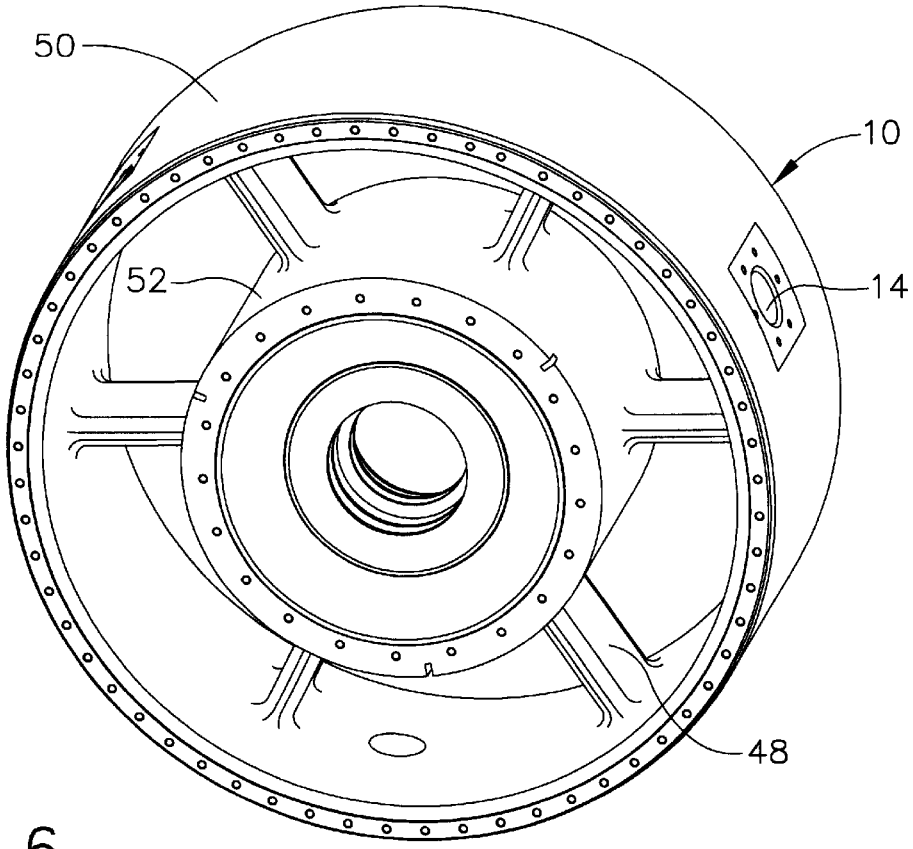
FIG. 6 is a perspective view of the thermally isolated housing without the liner assembly formed in accordance with the present invention.
Figure 7:
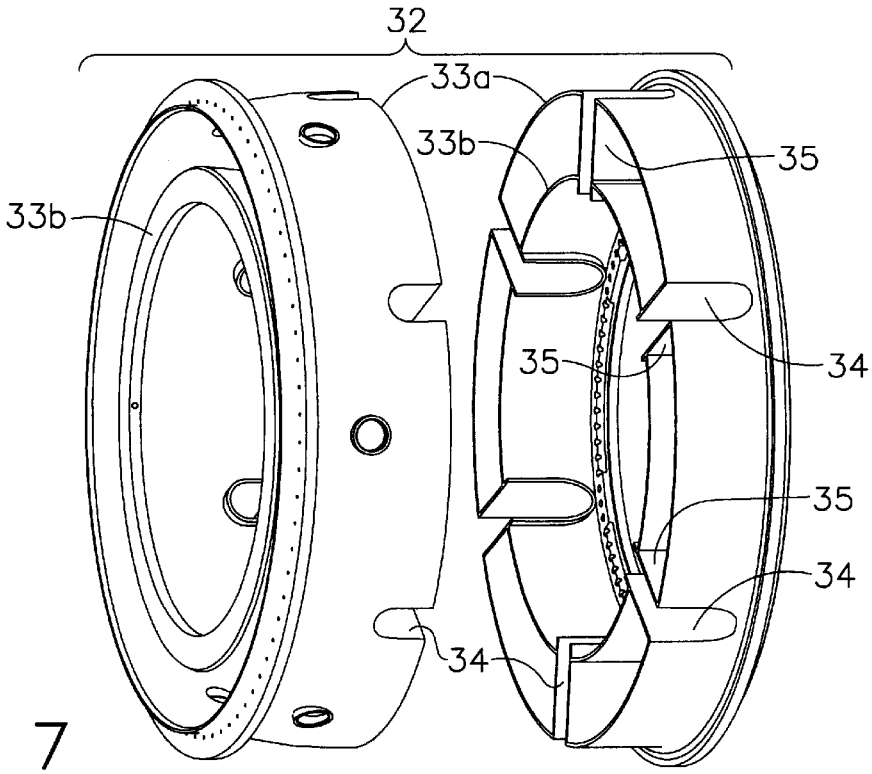
FIG. 7 shows an isometric view of the floating liner assembly formed in accordance with the present invention.
Figure 8A:
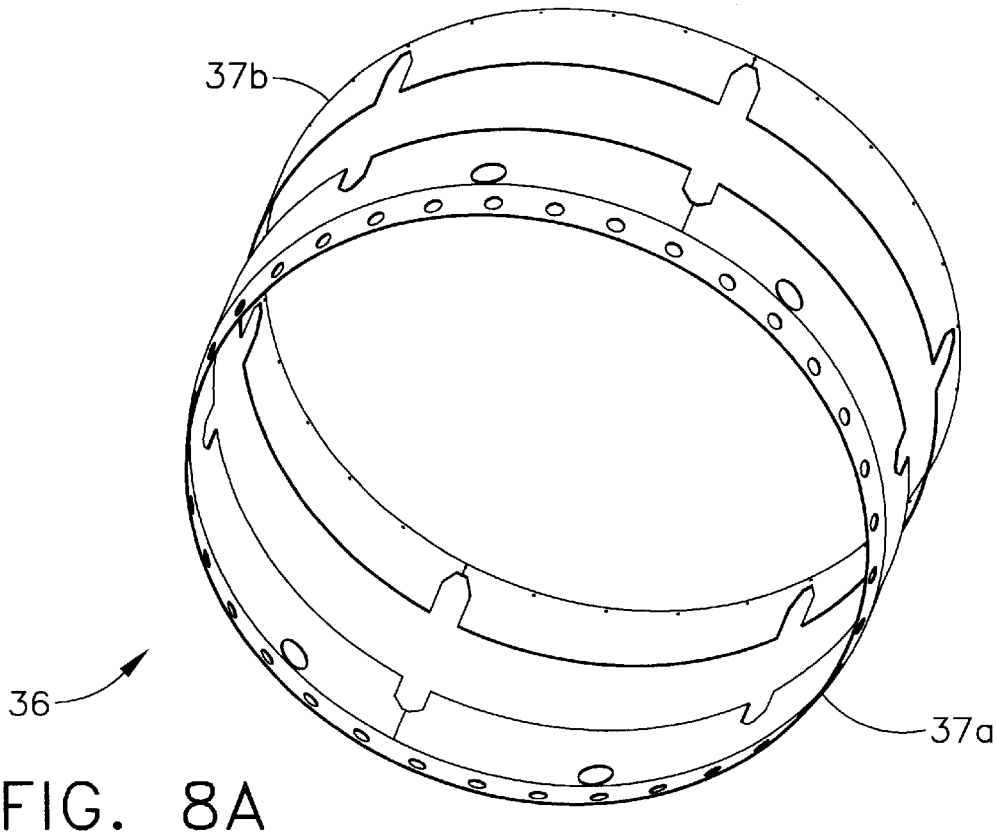
FIGS. 8*a* and 8*b* show perspective views of portions of the inner and outer baffle members.
Figure 8B:
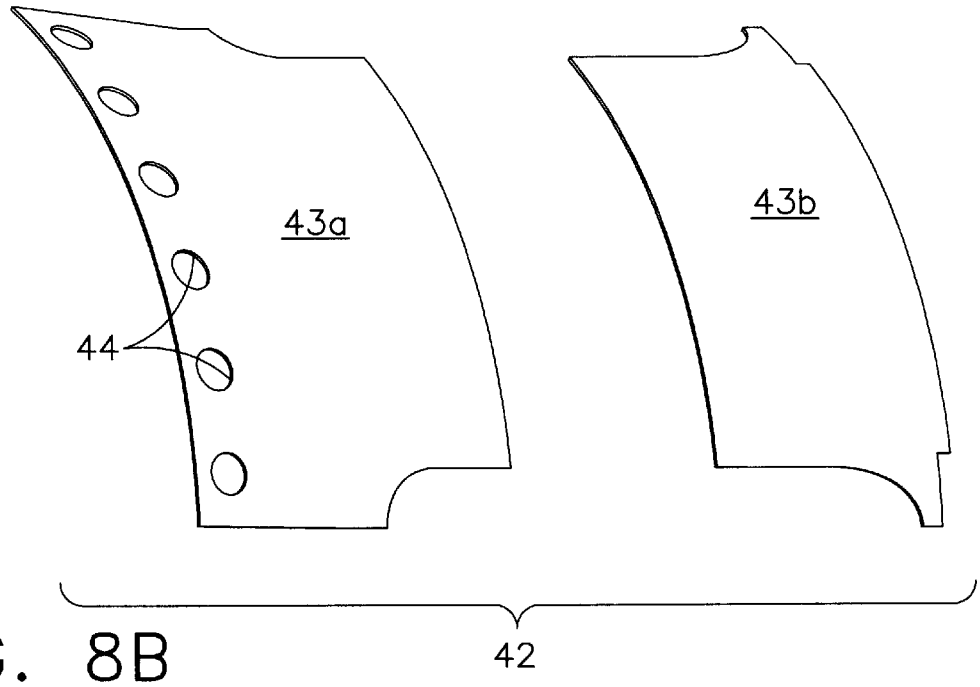
Figure 9A:
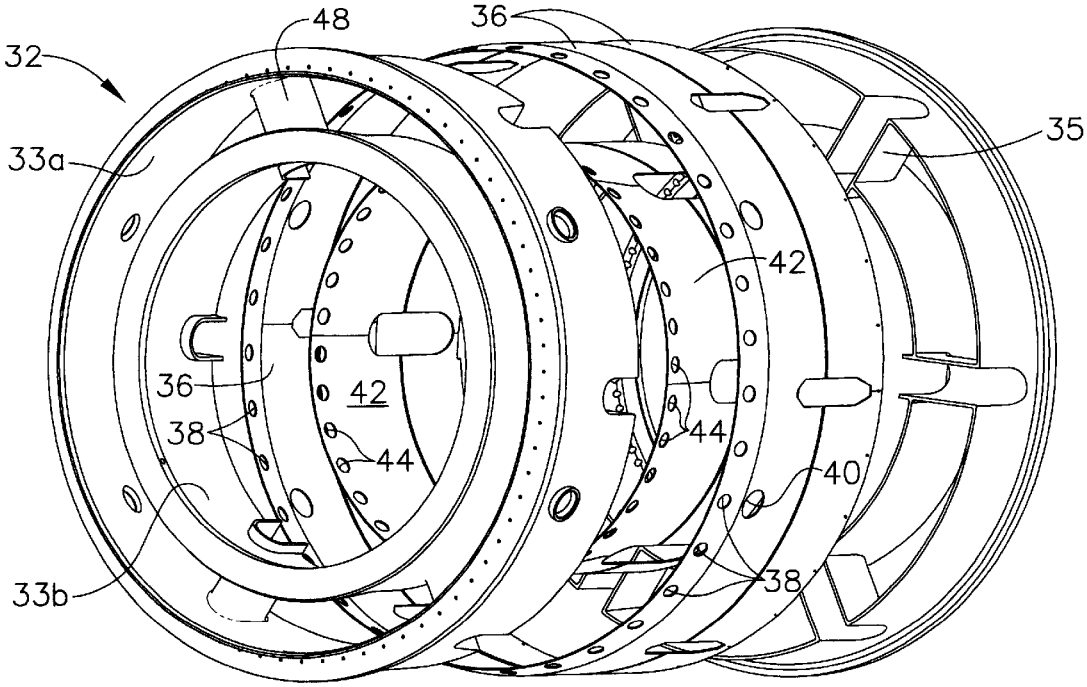
FIG. 9*a* shows an exploded perspective view of the thermally isolated housing, baffles and floating liner assembly formed in accordance with the present invention.
Figure 9B:
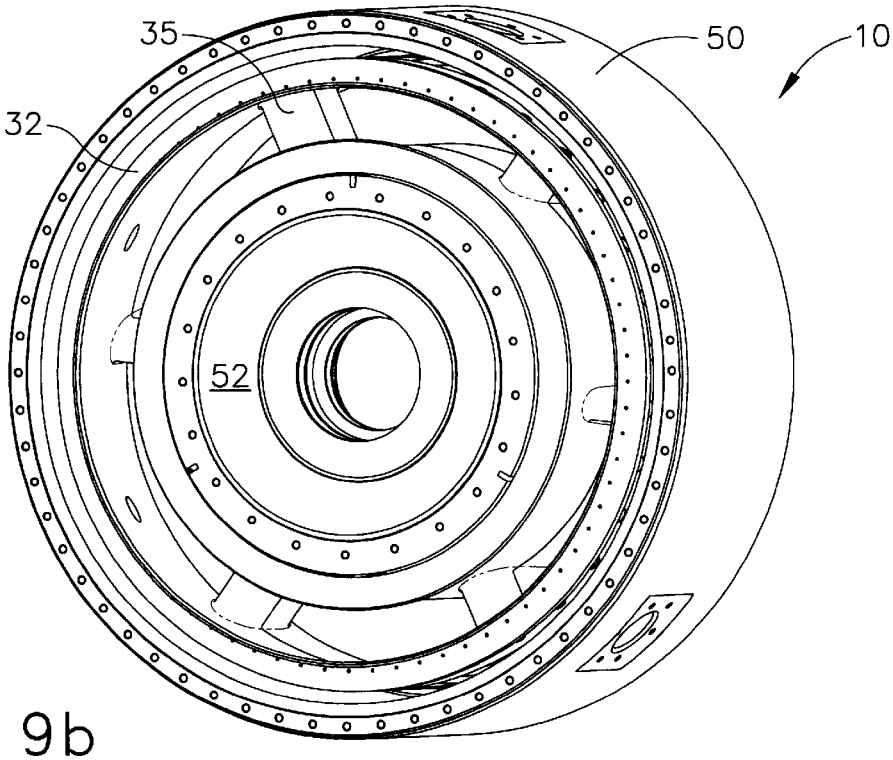
FIG. 9*b* shows a view of the floating liner and baffle assembled into the thermally isolated housing as formed in accordance with the present invention.

As shown in FIGS. 2 and 5 and 6, thermally isolated housing 10 encloses a cooling apparatus 11 that can include a number of radially-aligned components. Among the components can be a floating liner 32 that may be formed as a single assembly or, preferably, constructed from outer and inner ring members 33*a* and 33*b*, respectively. When assembled, the outer ring member 33*a* may surround and can be radially-spaced from the inner ring member 33*b*. A number of hollow liner struts 35 may extend between the ring members. A number of openings 34 may extend through each of the outer and inner ring-shaped members 33*a* and 33*b* to form an air flow passageway through outer ring member 33*a*, strut 35 and inner ring member 33*b*, allowing a single stream of cooling air to circulate adjacent each floating liner ring member as will become clear.

Cooling apparatus 11 can also include an outer baffle assembly 36 that may be formed as a single, cylindrically-shaped member or, preferably, may be formed from two separate, cylindrically-shaped portions 37*a* and 37*b*, respectively. Portions 37*a* and 37*b* may be welded together to form a closed cylinder during assembly. When assembled, outer baffle assembly 36 can enclose floating liner outer ring member 33*a* and 33*b*. A plurality of circumferentially-spaced openings 38 and 40 may extend through outer baffle portion 37*a*, allowing cooling air to pass through baffle portion 37*a* and flow adjacent to floating liner 32. Each of the portions 37*a* and 37*b* further includes aligned slot portions 41 that engage one another to form enlarged openings as baffle portions 37*a* and 37*b* are assembled. As will be explained, the enlarged openings formed by slots 41 enclose strut-shaped connecting members forming additional air passageways through the baffle assembly 36.

A further part of cooling apparatus 11, inner baffle assembly 42, may be arranged within floating liner inner ring member 33*b*. Inner baffle assembly 42 may be formed as a single, cylindrically-shaped member or, preferably, may be formed from separate, cylindrically-shaped members 43*a* and 43*b*, respectively. Further, each of the cylindrical members 43*a* and 43*b* may, itself, be formed by a number of arc-shaped segments welded to form the continuous cylinder. The number of segments can depend on the number of struts and contour shape. By forming the inner baffle cylindrical portions from a number of arc-shaped segments, ease of assembly is assured. A number of openings 44 extend through inner baffle assembly 42, allowing cooling air to circulate through the inner baffles 42 and adjacent floating liner inner ring member 33*b*.

Figure 3:
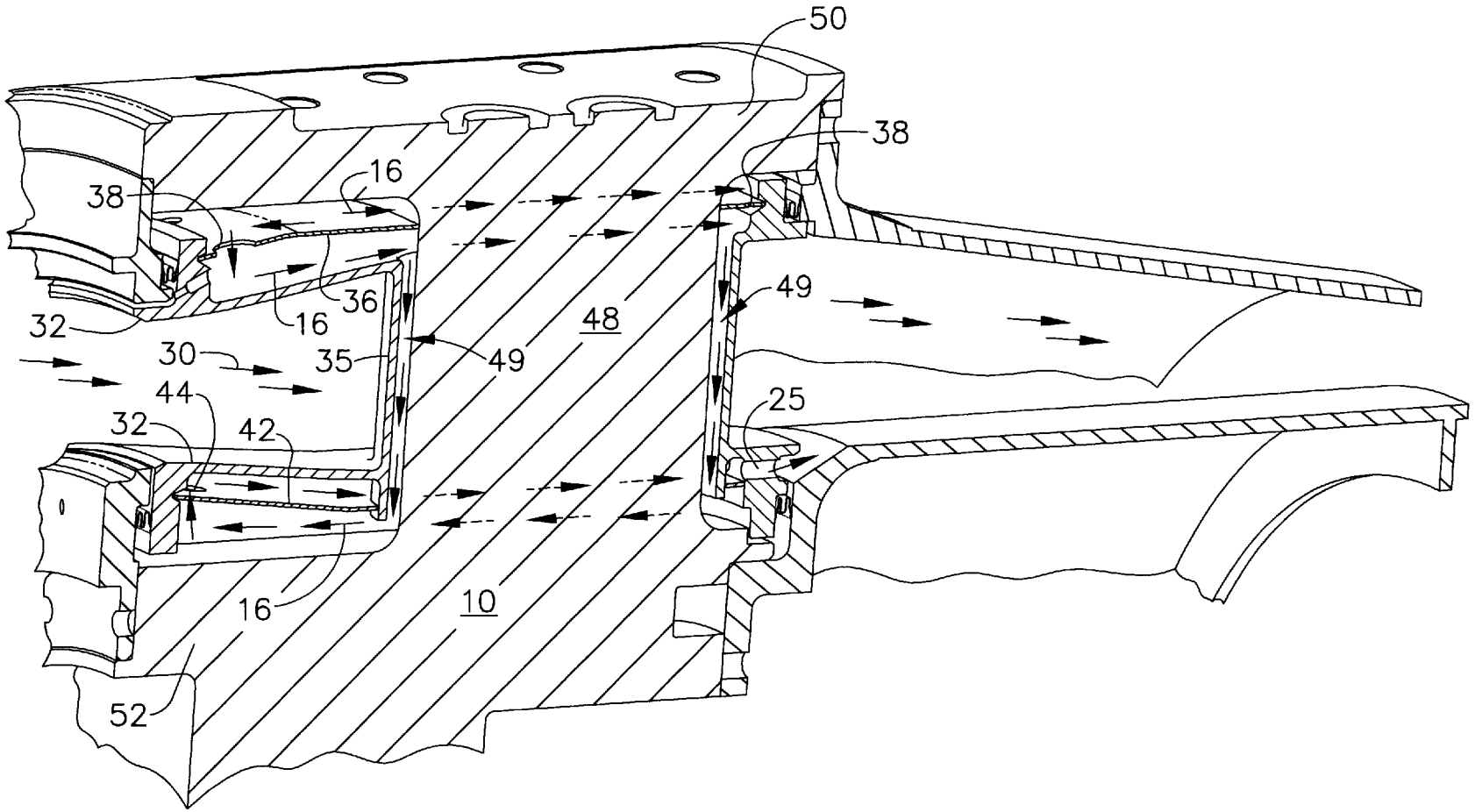
FIG. 3 is an exploded view taken along the lines A—A in FIG. 2.
Figure 4:
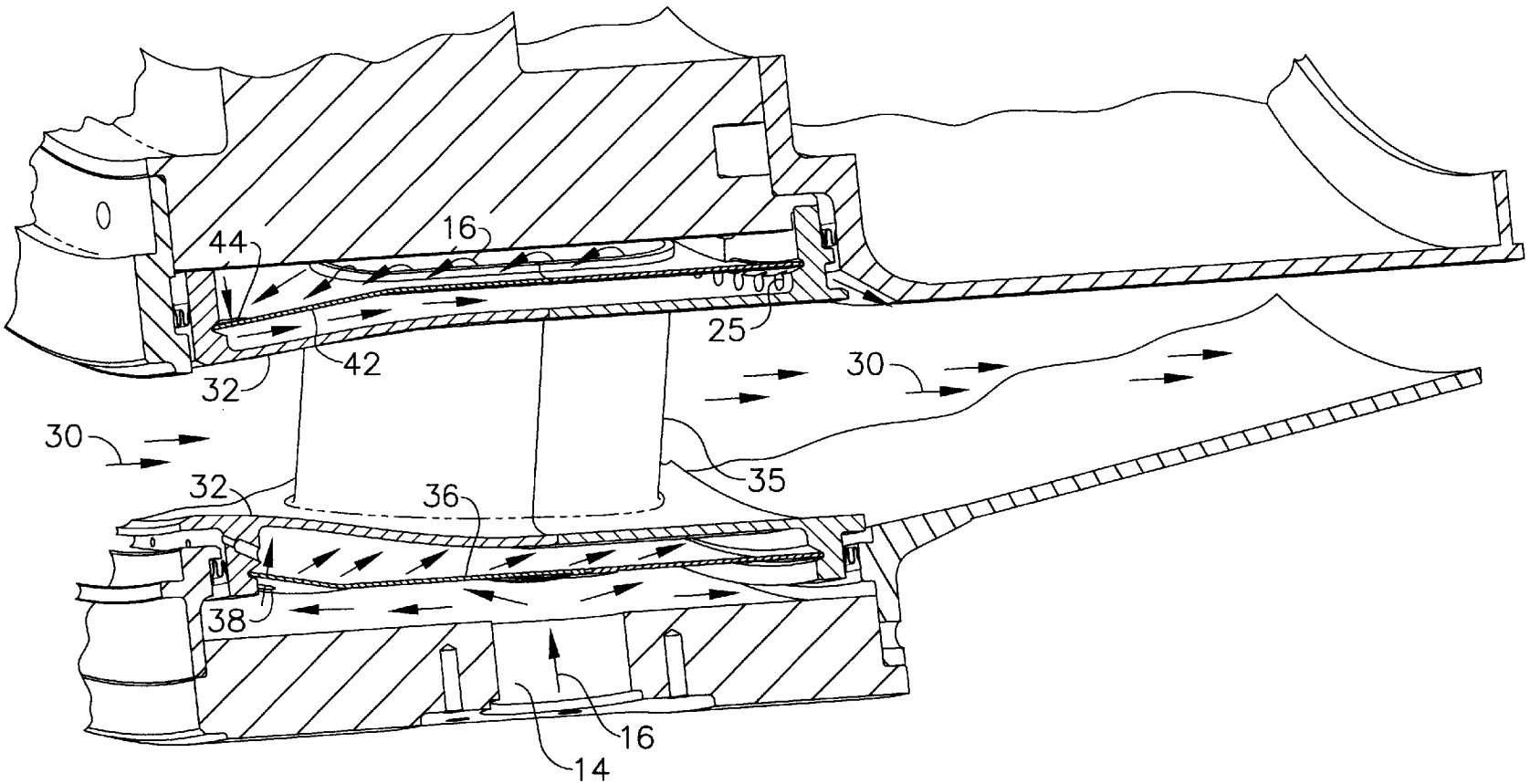
FIG. 4 is an exploded view taken along the lines B—B in FIG. 2.

Referring now to FIGS. 3 and 6, thermally isolated housing assembly 10 can further include a number of radially-disposed hollow housing struts 48 extending between and joining an outer shroud ring-shaped housing member 50 and a cylindrically-shaped inner hub member 52. This assembly allows cooling airfoil to be circulated between outer housing member 50 and inner hub 52, for cooling the bearings and seal assemblies contained within hub 52. When assembled, cooling apparatus 11 having floating liner assembly 32 and associated outer baffle assembly 36 and inner baffle assembly 42, is positioned between outer housing member 50 and inner hub 52, with floating liner struts 35 encasing the housing struts 48 and creating an air flow passageway 49 there between.

Referring again to FIG. 1, a number of circumferentially-spaced clocking or dowel pins 54 may extend between housing 10 and a forward portion of floating liner 32 for properly orienting floating liner 32 within housing 10. Controlling circumferential expansion and orientation are particularly important during the engine operating thermal cycle.

The method of the present invention creates a single air circuit capable of circulating compressed air within the engine compartment adjacent floating liner outer and inner rings 33*a* and 33*b*, respectively. As shown in FIGS. 2–5, a stream of compressed cooling air 16 enters housing 10 via a number of the inlet openings 14. As the compressed air impinges on the outer baffle assembly 36, it diffuses, with most of the cooling air 16 moving toward the forward end 20 of housing 10, while the remaining cooling air 16 moves toward the aft end 23 of housing 10. The cooling air stream 16 may move through the openings 38 and 40 in outer baffle 36 and flow adjacent to the surface of floating liner outer ring 33*a* in both axial and circumferential directions. This extracts heat from all outer surfaces of floating liner outer ring 33*a* forming a boundary with the hot flow gases 30. A further portion of cooling air 16 may flow inwardly through the openings in floating liner outer ring 33*a* and into the through passageway 49 defined by housing strut 48 and floating liner strut 35. The cooling air exits via additional openings 34 in the floating liner inner ring member 33*b* and is directed between inner baffle 42 and floating liner inner ring 33*b*. The cooling stream of air can collect heat from the floating liner inner ring 33*b* and expel it through outlets 25 into the stream of combustion gases 30 flowing through exhaust 28.

Figure 10:
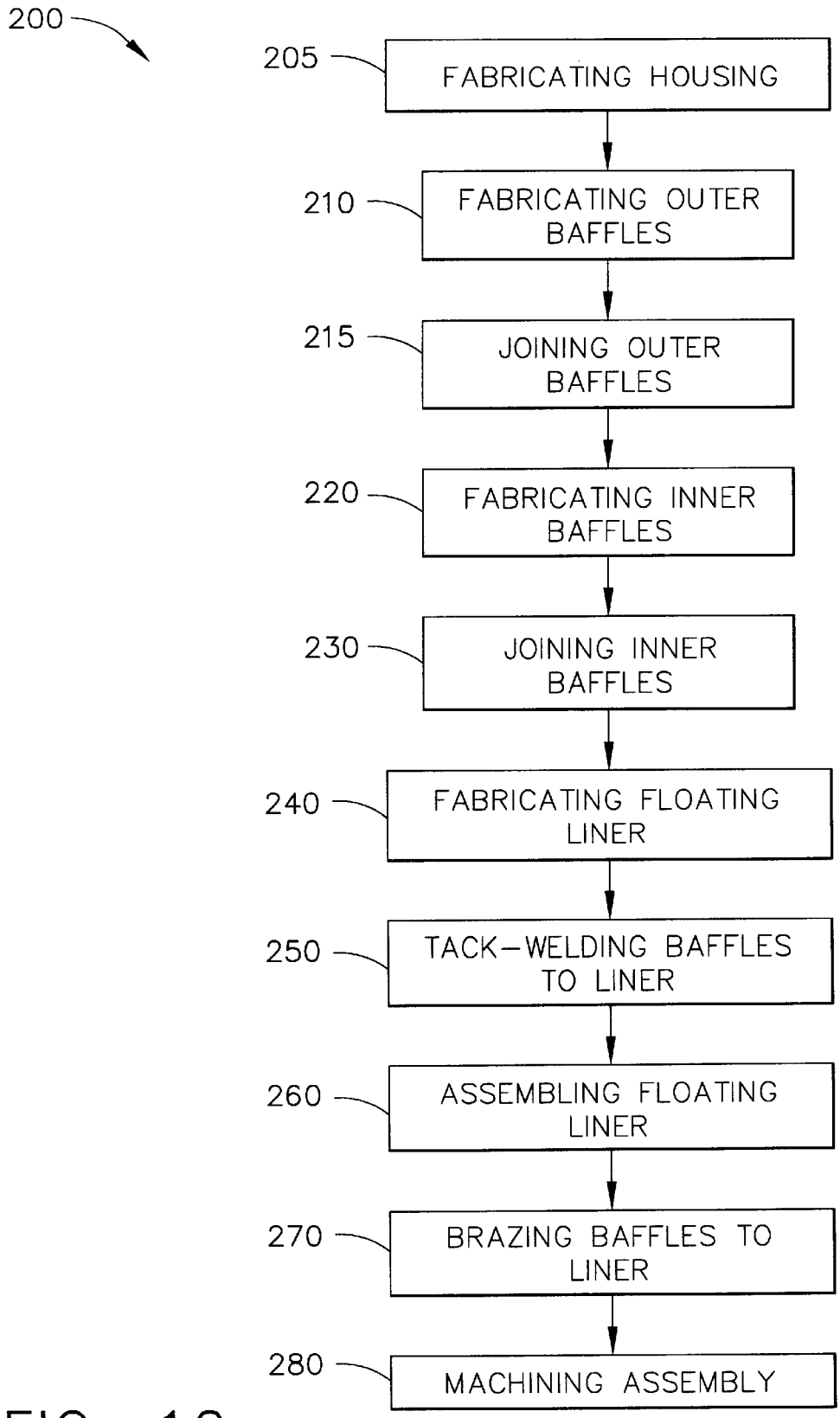
FIG. 10 shows a method of fabricating and assembling the thermally isolated housing, floating liner and baffle assembly in accordance with the present invention to provide the apparatus shown in FIG. 1.

The present invention is also directed to a method of fabricating and assembling housing 10 with its enclosed apparatus 11 including floating liner 32, outer baffle 36, and inner baffle 42. Referring now to FIG. 10, wherein the method of fabricating the thermally isolated apparatus is shown at 200. At step 205, the outer housing member 50, inner ring 52 and connecting housing struts 48 may be fabricated either by casting or machining. During the step 210, the outer baffle members 37*a* and 37*b* may be rolled from sheet metal and joined to form the closed ring-shaped baffle assembly 36. During fabrication step 215, the baffle members 37*a* and 37*b* may be joined together by brazing or welding to form a single circular member. During the step 220, each of the inner baffle members 43*a* and 43*b* may be formed of multiple separate segments of sheet metal welded end-to-end to form the ring-shaped baffle members 43*a* and 43*b*, respectively. During step 230, the two inner baffle rings may be joined together to form inner baffle assembly 42. Next, during step 240, the floating liner assembly 32 may be cast as one unit and cut (EDM) into two halves or as separate members 33*a* and 33*b* including a portion of the liner struts 37 cast with each member. During step 250, the assembled outer baffle assembly 36 can be tack-welded about floating liner member 33*a* while the assembled inner baffle assembly 42 is tack welded within floating liner 33*b*. During step 260, inner floating liner 33*b* may be positioned within outer floating liner 33*a* and the entire assembly can be arranged within housing 10. Finally, during step 270, outer baffle assembly 36, floating liner assembly 32 and inner baffle assembly 42 may be welded or brazed to form a unitary structure having single continuous passageway extending within housing 10.

In the method of the present invention, apparatus 11 is simply supported by adjacent structures such as doweling pins 54 and is not directly attached to outer housing member 50, inner hub 52 or housing struts 48. This assures that sufficient thermal expansion of the various components of apparatus 11 may take place when subjected to the hot combustion gases 30. A final machining shown as step 280 may be performed to achieve the critical dimensions of apparatus 11 as well as of housing 10.

In a further aspect of the present invention, each of the baffle assemblies 36 and 42 may be formed as an integral casting. Likewise, the floating liner 32 may be formed of a single casting, rather than the two separate members 33*a* and 33*b*.

It should be understood, of course, that the foregoing relates to preferred embodiments of the invention and that modifications may be made without departing from the spirit and scope of the invention. Any such modifications should in no way limit the scope of the invention, which should only be determined based on the following claims.

We claim:

1. A method of thermally isolating a turbine engine housing from high temperatures created by combustion gases flowing through the engine housing, comprising the steps of:

forming a floating liner assembly with a plurality of openings extending there through;

forming an outer baffle assembly with a plurality of openings extending there through;

forming an inner baffle assembly with a plurality of openings extending there through;

arranging the floating liner assembly, the outer baffle assembly and the inner baffle assembly in the turbine engine housing to form a single passageway for conveying a stream of compressed, cooling air against surfaces of the floating liner to collect heat from the floating liner and expel the heat into the stream of combustion gases flowing through turbine engine housing; and forming the housing with an outer ring-shaped housing member and an inner hub connected by a number of hollow housing struts having lengthwise passages for delivering air/oil from the outer ring-shaped housing member to the inner hub.

2. The method according to claim 1, including the step of forming the floating liner assembly as a single member having a generally cylindrically-shaped configuration including outer and inner ring portions separated by a plurality of hollow liner struts.

3. The method according to claim 1, including the step of forming the floating liner assembly as separate inner and outer ring-shaped liner members each having a number of openings, and forming a plurality of hollow struts extending between the ring-shaped liner members forming a cooling air passageway adjacent each of the floating liner ring-shaped members.

4. The method according to claim 3, including the step of welding inner ring-shaped liner member within the outer ring-shaped liner member to form the floating liner assembly.

5. The method according to claim 4, including the step of positioning the outer baffle assembly about the outer ring-shaped liner member before arranging the inner ring-shaped liner member within the outer ring-shaped liner member.

6. The method according to claim 4, including the step of positioning the inner baffle assembly within the inner ring-shaped liner member before arranging the inner ring-shaped liner member within the outer ring-shaped liner member.

7. The method according to claim 1, including the step of forming the outer baffle assembly from two separate baffle members each having a generally cylindrically-shaped configuration and a number of through openings forming cooling air passageways.

8. The method according to claim 7, including the step of welding the two separate outer baffle members to form a single, generally cylindrically-shaped member.

9. The method according to claim 1, including the step of forming the outer baffle assembly as a single, generally cylindrically-shaped member having a plurality of through openings forming cooling air passageways extending there through.

10. The method according to claim 1, including the step of forming the inner baffle assembly from a pair of similarly-shaped cylindrical members attached to one another and having a number of through openings creating cooling air passageways.

11. The method according to claim 10, including the step of forming each cylindrical inner baffle member from a number of arc-shaped segments attached end-to-end.

12. A method for thermally isolating a gas turbine engine housing having an outer ring-shaped housing member and an inner hub attached by housing struts from high temperatures created by combustion gases flowing through the turbine engine, comprising the steps of:

positioning a floating liner assembly between the inner hub and the outer ring-shaped housing member and arranging a plurality of liner struts to enclose the housing struts, with a plurality of openings extending through the floating liner;

positioning an outer baffle assembly about the floating liner assembly, with a plurality of openings extending through portions of the outer baffle assembly;

positioning an inner baffle assembly within the floating liner assembly, with a plurality of openings extending through portions of the inner baffle;

creating a single, continuous passageway for delivering pressurized air through openings in the outer ring-shaped housing member that impacts and flows through the openings in the outer baffle assembly, the floating liner assembly, the liner struts and the inner baffle assembly for collecting heat from the floating liner and expelling the heat to a stream of combustion gases flowing through the gas turbine engine; and forming the floating liner assembly as separate inner and outer ring-shaped liner members having a number of openings, forming a cooling air passageway adjacent each of the floating liner ring-shaped members; and welding the inner ring-shaped liner member within the outer ring-shaped liner member to form a unitary floating liner assembly.

13. The method according to claim 12, including the step of forming the outer baffle assembly from two separate baffle members each having a generally cylindrically-shaped configuration and a number of through openings forming cooling air passageways.

14. The method according to claim 13, including the step of welding the two separate outer baffle members to form a single, generally cylindrically-shaped member.

15. The method according to claim 12, including the step of forming the inner baffle assembly from a pair of similarly-shaped cylindrical members attached to one another and having a number of through openings creating cooling air passageways.

16. The method according to claim 15, including the step of forming each cylindrical inner baffle member from a number of arc-shaped segments attached end-to-end.

17. The method according to claim 12, including the step of positioning the outer baffle assembly about the outer ring-shaped floating liner member and positioning the inner baffle assembly within the inner ring-shaped floating liner assembly before positioning the floating liner members with the ring-shaped outer housing member.

18. The method according to claim 17, including the step of brazing the outer baffle assembly, the floating liner members and the inner baffle assembly into a unitary member forming a single air flow through passage extending from the outer housing to a stream of combustion gases flowing through the gas turbine engine.

19. A method for thermally isolating a gas turbine outer ring-shaped housing member from high temperatures created by combustion gases flowing through the turbine engine, comprising the steps of:

positioning a floating liner assembly between an inner hub and the outer ring-shaped housing member and forming the floating liner assembly from separate, inner and outer ring-shaped liner members, having a number of openings, forming an cooling air passageway around each of the floating liner members;

positioning an outer baffle assembly having two similar, generally cylindrically-shaped members to surround the floating liner outer ring-shaped member, and forming the outer baffle assembly with a plurality of through openings;

positioning an inner baffle assembly having two similar, generally cylindrically-shaped members within the floating liner inner ring-shaped member, and forming the inner baffle assembly with a plurality of through openings; and creating a single, continuous passageway for delivering pressurized air through openings in the outer ring-shaped housing member that impacts and flows through the openings in the outer baffle assembly, the floating liner assembly, the liner struts and the inner baffle assembly for collecting heat from the floating liner and expelling the heat to a stream of combustion gases flowing through the gas turbine engine.

20. The method according to claim 19, including the step of brazing the outer baffle assembly, the floating liner members and the inner baffle assembly into a unitary member forming the single air flow passageway extending from the outer housing to the stream of combustion gases flowing through the gas turbine engine.

* * * * *